US008800572B1

(12) United States Patent
Hodge

(10) Patent No.: US 8,800,572 B1
(45) Date of Patent: Aug. 12, 2014

(54) FIXED POINT BARBER COMB AND METHODS OF USE

(71) Applicant: Morono Hodge, Washington, DC (US)

(72) Inventor: Morono Hodge, Washington, DC (US)

( * ) Notice: Subject to any disclaimer, the term of this patent is extended or adjusted under 35 U.S.C. 154(b) by 0 days.

(21) Appl. No.: 13/770,608

(22) Filed: Feb. 19, 2013

(51) Int. Cl.
*A45D 24/34* (2006.01)
*A45D 24/36* (2006.01)

(52) U.S. Cl.
CPC ..... *A45D 24/36* (2013.01)
USPC ..... 132/213.1

(58) Field of Classification Search
CPC ..... A45D 24/02; A45D 24/04; A45D 24/10; A45D 24/34; A45D 24/36; A45D 2024/34; A45D 2024/005
USPC ..... 132/200, 120, 125, 213, 213.1, 214, 132/215, 148
See application file for complete search history.

(56) References Cited

U.S. PATENT DOCUMENTS

| | | | | |
|---|---|---|---|---|
| 1,239,951 | A * | 9/1917 | Peckham | 132/148 |
| 1,332,587 | A * | 3/1920 | Yeomans | 30/30 |
| 2,245,469 | A | 6/1941 | Ecklund et al. | |
| 3,029,509 | A * | 4/1962 | Peters | 30/30 |
| 4,517,998 | A | 5/1985 | Furco | |
| 4,830,031 | A | 5/1989 | Quinones et al. | |
| 5,107,869 | A | 4/1992 | Henry | |
| 2008/0078418 | A1 | 4/2008 | Ghoorchian | |
| 2009/0217937 | A1 | 9/2009 | Nelson | |
| 2010/0101596 | A1 | 4/2010 | Regalado et al. | |
| 2011/0067724 | A1 * | 3/2011 | Regalado et al. | 132/213.1 |

FOREIGN PATENT DOCUMENTS

| | | | |
|---|---|---|---|
| CN | 201550792U | U | 8/2010 |
| CN | 201585578 | U | 9/2010 |
| CN | 202128017 | U | 2/2012 |
| CN | 202311815 | U | 7/2012 |
| JP | 2007325889 | A | 12/2007 |
| KR | 20080076887 | A | 8/2008 |
| WO | W003061428 | A1 | 7/2003 |

* cited by examiner

*Primary Examiner* — Rachel Steitz
(74) *Attorney, Agent, or Firm* — Winston & Strawn LLP; Melinda K. Lackey; Dustin J. Edwards

(57) ABSTRACT

The present invention provides a barber instrumentality useful for accurate and reproducible hair styling. In particular, methods are provided herein for the use of the instrumentality wherein precise measurements can be taken to reproduce certain styles within a haircut, including cutting with reference to the outline of the hair on the head (the hairline), especially around the temple.

3 Claims, 8 Drawing Sheets

FIXED POINT BARBER COMB AND METHODS OF USE

FIELD OF THE INVENTION

This invention relates to the field of styling hair in general, and more particularly, relates to facilitation of accurate and reproducible measurements during cutting with reference to the hairline.

BACKGROUND OF THE INVENTION

Hair styling involves techniques that require creativity and technical precision. Training and experience are paramount to being successful at hair styling. However, even the most highly trained and experienced stylist must deal with difficult hair styles on a daily basis and with customers that request and expect precision cuts and styles. One specific challenge to many stylists or barbers is the need to accurately and reproducibly trim a customer's hairline on both sides of the head; resulting in mirror image cuts on either side of the head that are both straight and reflect the customer's request. The hairline across the forehead and temples presents unique difficulty, given the lack of useful measuring tools to ensure reproducibility on both sides. Of particular concern for a stylist or barber are those customers that have very short hair, where slight imperfections in shape or angles of the hairline are highly noticeable and undesirable.

Currently known combs are different from the current invention in specific and critical ways. Prior combs, such as those disclosed in U.S. Pat. Application Nos. 20100101596, 20080078418 and U.S. Pat. No. 5,107,869, are focused on the angle and length of the hair and disregard the hairline. These combs do not provide a terminal, fixed reference point that extends from the spine of the comb which is useful for very short hair to prevent imperfections in the resulting hair cut or style. These combs also do not provide a slideable, second reference point.

While other prior combs provide means to measure angles of hair styles, such as U.S. Pat. Application No. 20100101596, they do not allow the user to reproducibly maintain a certain measurement of the hairline via a terminal, fixed reference point and second, slideable reference point. Other prior combs have slideable points, but these slideable points interfere with both establishing two discrete points from which the barber or stylist may work with clippers to accurately reproduce a hair cut or style and with the general use of the comb itself. The prior combs are simply too bulky for use with clippers, for example.

The present invention is directed to overcoming the issues and limitations of prior art combs set forth above.

SUMMARY OF INVENTION

The present invention provides a novel barber or styling comb that provides a user with a precise measurement of a haircut of a hairline, particularly an outline or "shape-up," on one side of one's head to allow for its accurate reproduction on the other side of the same head, or in the alternative, provides the user the ability to cut the hairline at a constant or predetermined set of measurements, such as at an angle, where certain proportions are to be maintained even if they are not mirror images on either side of the head. For the purposes of this invention, "hairline" refers to the edge of a person's hair or the outline where one's hair growth starts, especially located adjacent to the scalp around the forehead and temples or adjacent to the skin on the neck. This is achieved by providing a fixed reference point on the terminal end of the comb and a slideable reference point that can be placed at any location along the length of the comb. In a preferred embodiment, the reference points extend from the backbone of the comb in a planar fashion in a direction opposite the teeth of the comb.

In a preferred embodiment, the user of the novel comb places the fixed reference point at a particular point after shaping the initial side or area of the hairline. The slideable reference point can be placed at any desired location along the length of the comb to measure the outline of hair along the hairline to be reproduced on the next side or area of the hairline. Once this measurement occurs, the comb can be moved to any side or area of the haircut and the first style can be accurately reproduced at that side or area.

The foregoing and other features of the present invention become further apparent by reference to the following drawings and description.

BRIEF DESCRIPTION OF DRAWINGS

FIGS. 5A-8C provide three views of one embodiment of the slideable reference point.

Figure 1:
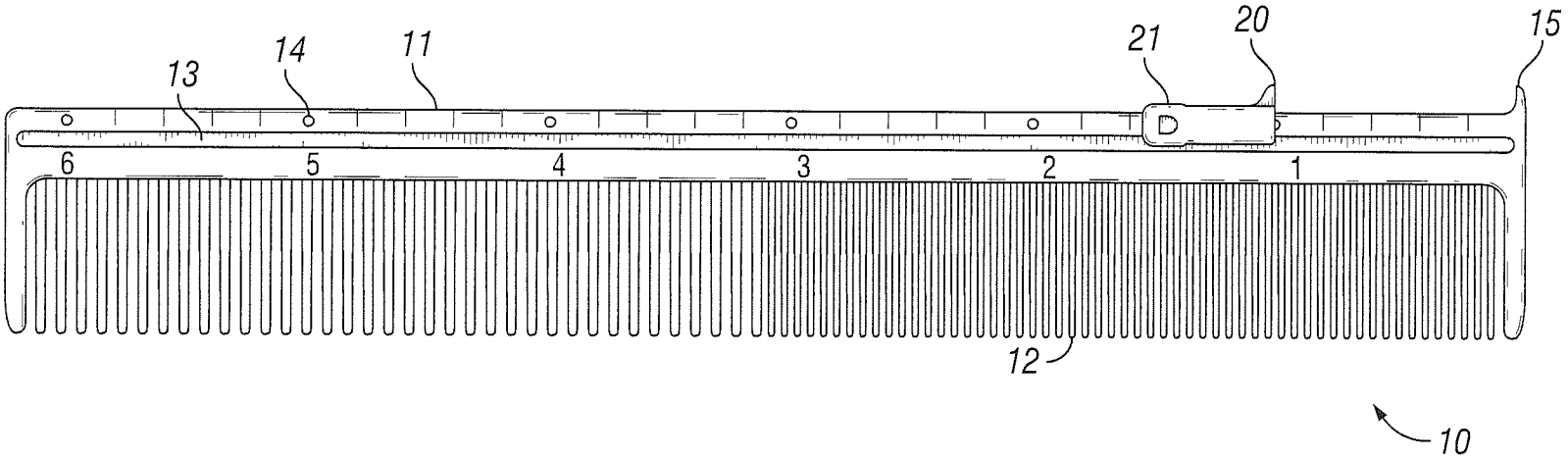
FIG. 1 is a side view of one embodiment of the barber comb.

While the present invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents, and alternatives falling within the spirit and scope of the invention as defined by the claims.

DETAILED DESCRIPTION OF INVENTION

In a preferred embodiment, the novel comb is illustrated by FIG. 1, where a barber comb (10) with a plurality of teeth (12) extending from a spine (11) in a planar fashion is improved by the addition of a terminal, fixed reference point (15). The fixed reference point (15) extends from the spine (11) in a planar fashion in the opposite direction from the teeth (12) of the comb. Grooves (13) similarly situated on both sides of the spine (11) of the comb (10), run parallel along the length of the spine (11). The comb (10) is further improved by the addition of a slideable reference point (20) slideably attached to the comb (10) and slideable along the grooves (13). The slideable reference point (20) is attached to the comb (10) via the grooves (13) by clamps (21) on the slideable reference point (20). The comb (10) is also further improved by the addition of indicators (14) spaced at pre-measured increments along the grooves (13). Indicators (14) can include notches, marks, numerals, or letters.

Figure 2:
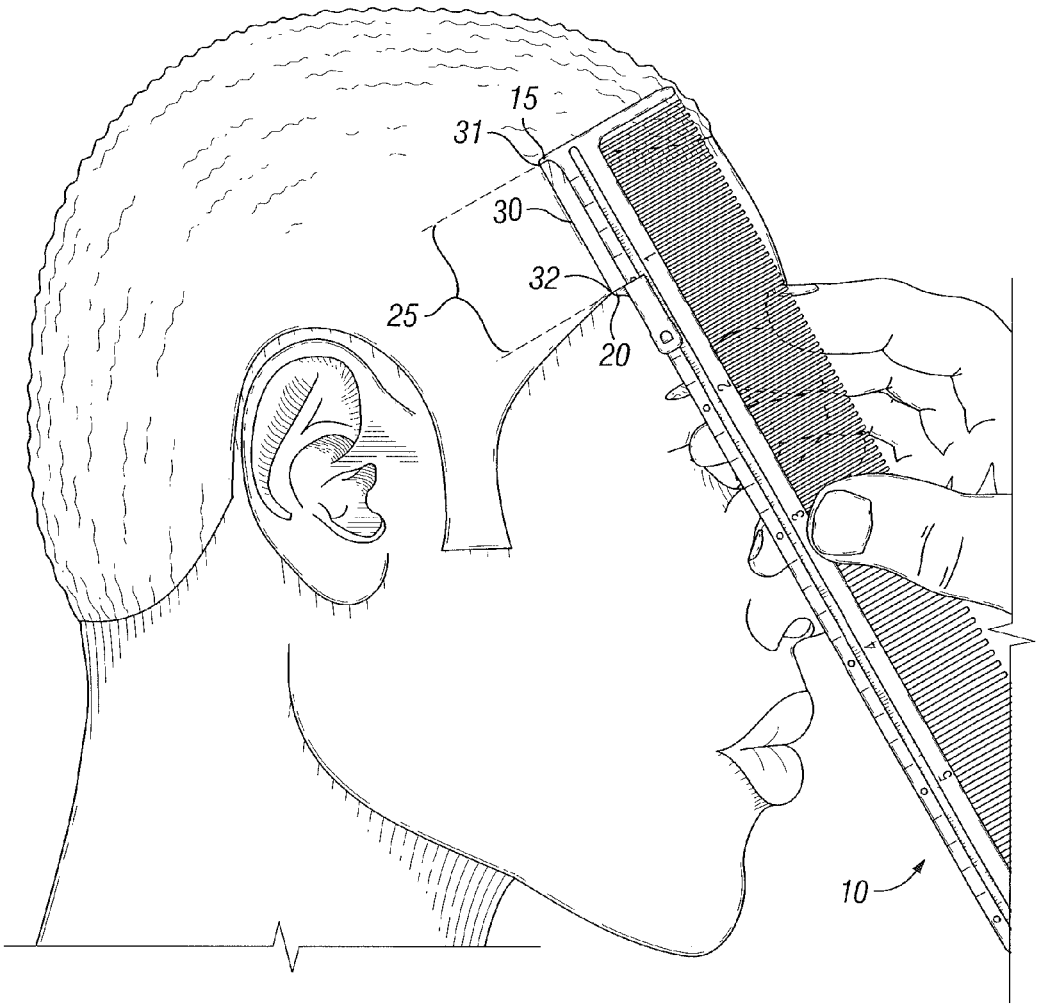
FIGS. 2-7 show the barber comb in FIG. 1 in use to accurately reproduce a hair cut or style from one side or area of the head to an opposite side or area of the head.
Figure 3:
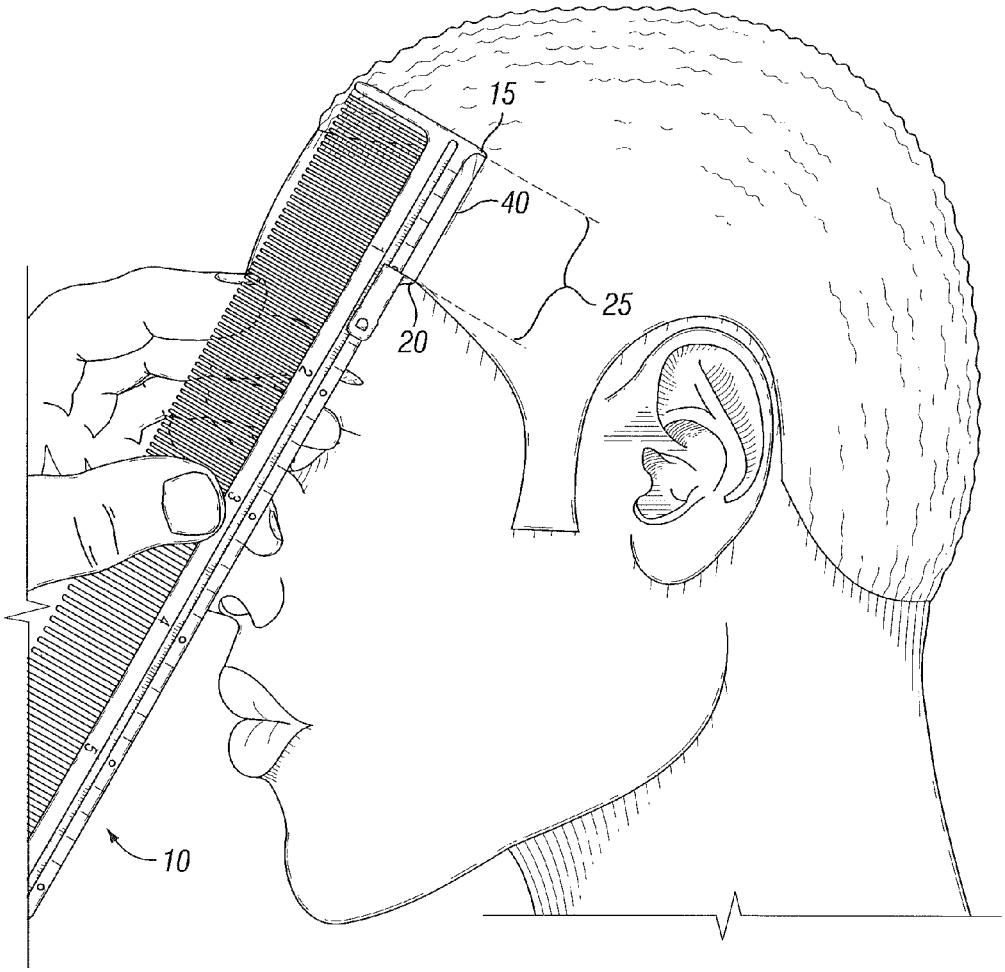

In a further preferred embodiment via the method depicted in FIG. 2, a barber or stylist, using the comb (10) embodied in FIG. 1, performs an initial cut or style of a customer's hair using the slideable reference point (20) to measure the outline of hair along a first area of the customer's hairline (30). After the initial cut or style, the fixed reference point (15) is placed at a first desired location (31) and the slideable reference point (20) is placed at a second desired location (32). After both points (15) and (20), respectively, have established a measurement (25) along the first area along the hairline (30), the comb can be moved to a second area along the hairline (40) in order to precisely replicate the first cut or style at that area using the measurement (25), as shown in FIG. 3.

Figure 4:
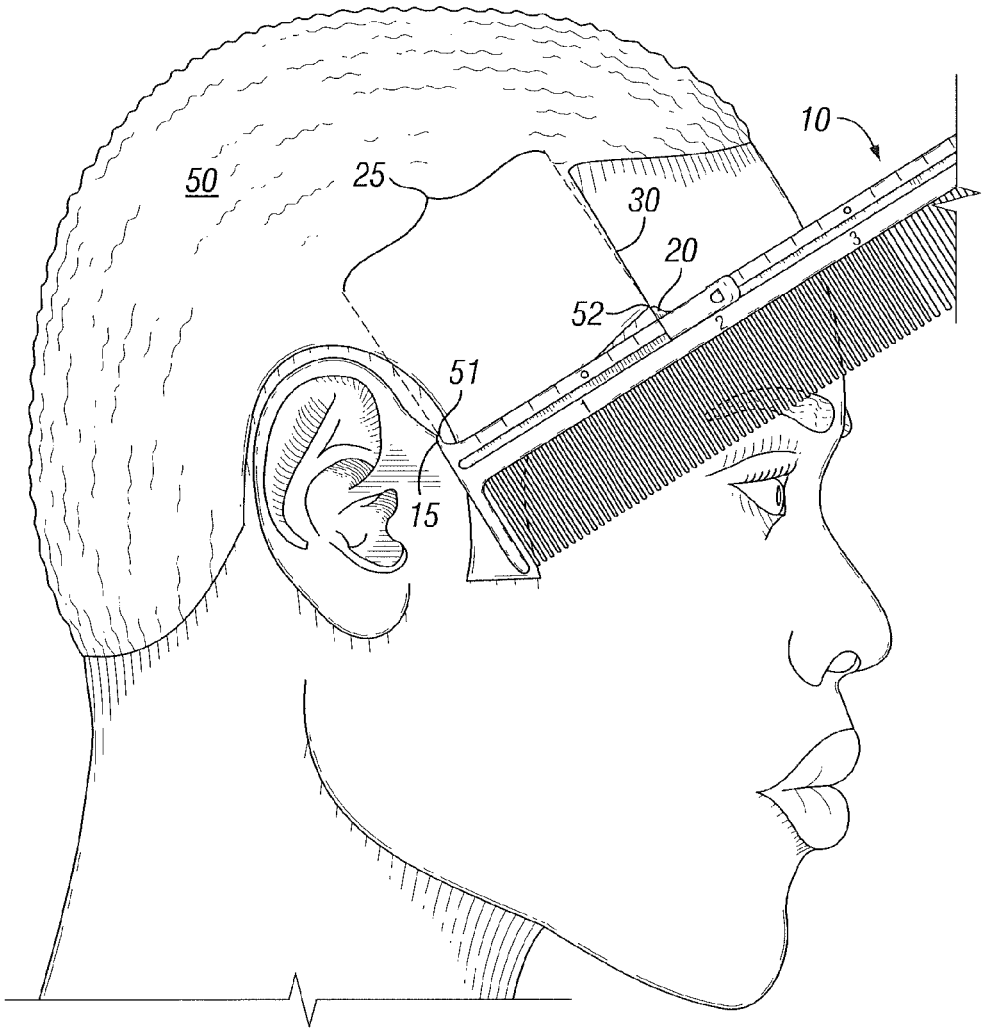
Figure 5:
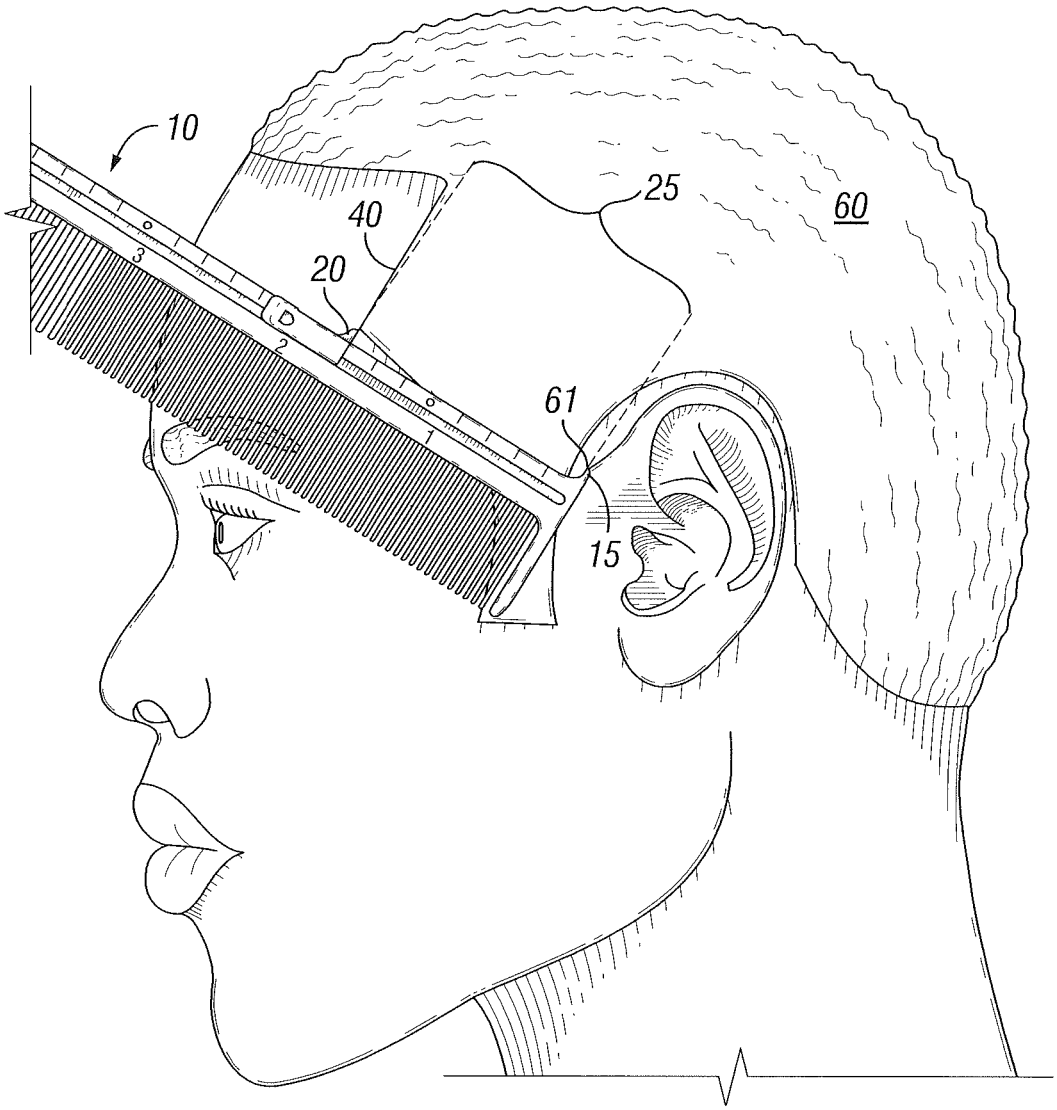

In a further preferred embodiment via the method depicted in FIG. 4, and inclusive of the method depicted in FIG. 2, a barber or stylist, after cutting the outline along the first area of the customer's hairline (30) with clippers, and using the comb embodied in FIG. 1, places the fixed reference point (15) at the junction (51) of the helix of the ear and the head on one side of the head (50). After placement of the slideable reference point (20) at a desired location (52) and the measurement (25) is obtained, the comb (10) is moved to the junction (61) of the helix of the ear and the head on the opposite side of the head (60), as shown in FIG. 5. The fixed reference point (15) is placed at this junction (61), and the barber or stylist is able to accurately replicate the first cut or style at the second area along the hairline (40) using the measurement (25). In the alternative, the slideable reference point (20) may be placed at the junctions (51, 61) to obtain the measurement (25).

Figure 6:
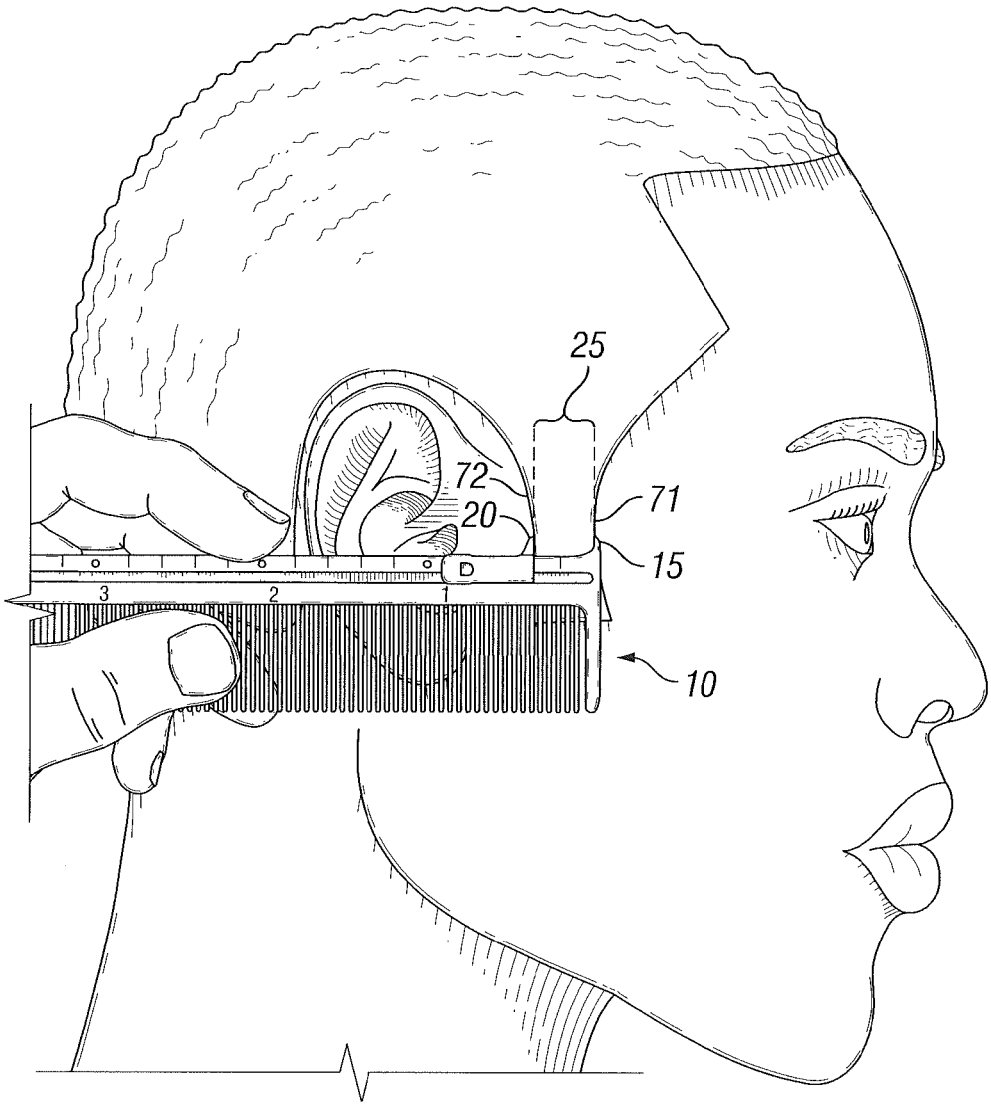
Figure 7:
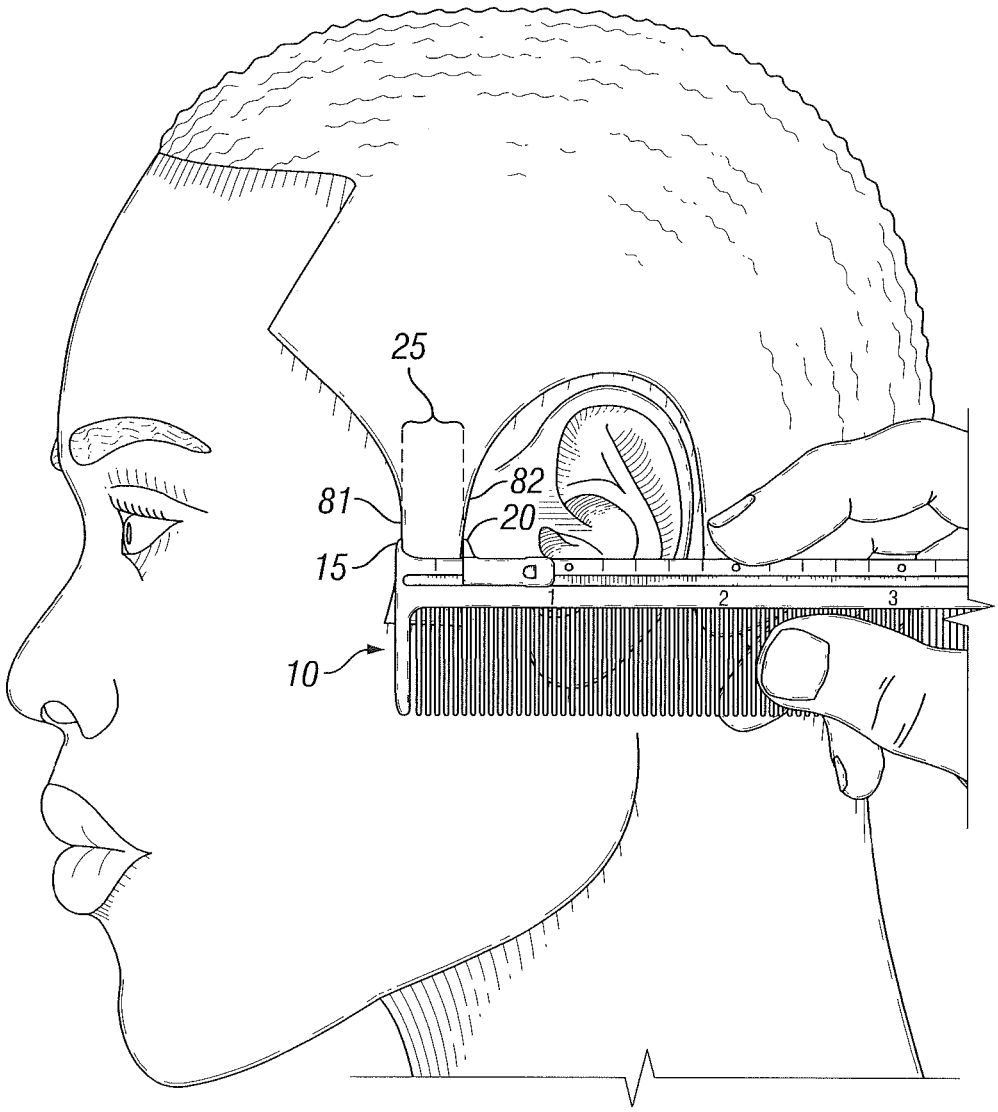

Additional embodiments allow for use of the invention for styling of other facial hair, including but not limited to mustaches, side burns, and eyebrows. FIG. 6 embodies a preferred embodiment using comb (10) with the fixed reference point (15) placed at a first desired location (71) along the first side sideburn and the slideable reference point (20) placed at a second desired location (72) along the first side sideburn. Once the two reference points have established the measurement (25), the fixed reference point is placed at a second desired location (81) along the second side sideburn with the slideable reference point (20) then being automatically placed at location (82) along the second side sideburn based on the measurement (25) for the stylist or barber's use to replicate the first cut on the second side sideburn, as shown in FIG. 7.

Figure 8A:
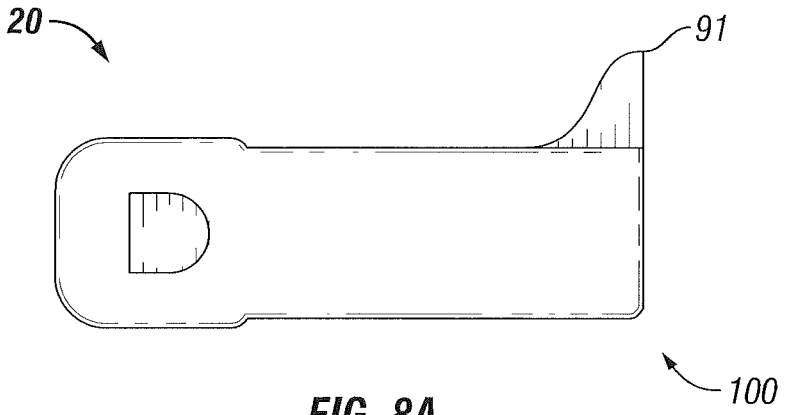
Figure 8B:
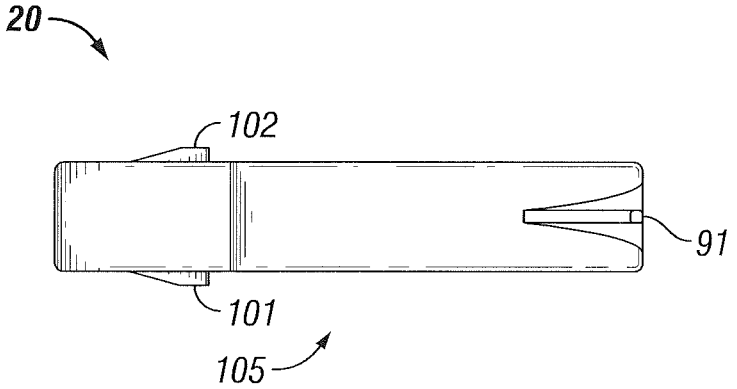
Figure 8C:
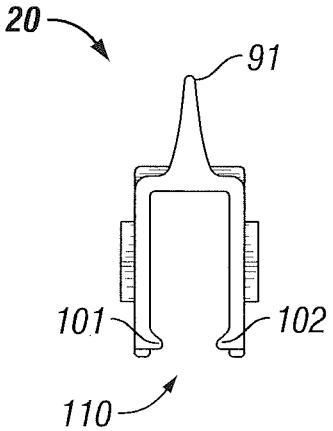

FIG. 8 provides three views of a preferred embodiment of the slideable reference point (20). FIG. 8A depicts a side view (100) showing the elevated portion (91) of the slideable reference point (20). FIG. 8B depicts a top view (105) showing clamping moieties (101 and 102) as well as the elevated portion (91) of the slideable reference point (20). FIG. 8C depicts a front view (110) showing the clamping moieties (101 and 102) as well as the elevated portion (91) of the slideable reference point (20).

Although various embodiments have been shown and described, the invention is not so limited and will be understood to include all such modifications and variations as would be apparent to one skilled in the art.

The invention claimed is:

1. A comb, comprising:

a spine;

a plurality of teeth extending from the spine in a planar fashion;

a plurality of indicators regularly spaced latitudinally along the length of the spine;

a fixed reference point with an elevated portion mounted at one end of the comb and extending outward from the spine in a planar fashion, in a direction opposite from the teeth;

a slideable reference point slideably attached to the spine via grooves that extend the length of the spine along both sides of the spine, the slideable reference point having an elevated portion extending outward from the spine in a planar fashion in a direction opposite from the teeth;

wherein the slideable reference point clamps into the two grooves; and wherein said elevated portions extend equidistant from said spine.

2. A method of accurately and reproducibly shaping a hairline of an individual's head, comprising:

providing a comb, comprising: a spine; a plurality of teeth extending from the spine in a planar fashion; a plurality of indicators regularly spaced latitudinally along the length of the spine; a fixed reference point with an elevated portion mounted at one end of the comb and extending outward from the spine in a planar fashion in a direction opposite from the teeth; a slideable reference point slideably attached to the spine via grooves that extend the length of the spine along both sides of the spine, the slideable reference point having an elevated portion extending outward from the spine in a planar fashion, in a direction opposite from the teeth; wherein the slideable reference point clamps into the grooves; and wherein said elevated portions extend equidistant from said spine;

cutting a hairline along a first side of the individual's head with clippers to a desired shape;

placing the elevated portion of the fixed reference point of the comb at the junction between the helix of the ear and the head on the first side of the individual's head;

adjusting the elevated portion of the slideable reference point to a desired location relative to the hairline along the first side of the individual's head to obtain a measurement of the shape of the hairline along the first side of the individual's head;

while maintaining the measurement of the shape of the hairline along the first side of the individual's head on the comb, placing the elevated portion of the fixed reference point of the comb at the junction between the helix of the ear and the head on the opposite side of the individual's head;

identifying location of the elevated portion of the slideable reference point relative to a hairline along the opposite side of the individual's head; and cutting the hairline along the opposite side of the individual's head with clippers to accurately and reproducibly match the shape of the hairline along the first side of the individual's head.

3. A method of accurately and reproducibly shaping an individual's hairline, comprising:

providing a comb, comprising: a spine; a plurality of teeth extending from the spine in a planar fashion; a plurality of indicators regularly spaced latitudinally along the length of the spine; a fixed reference point with an elevated portion mounted at one end of the comb and extending outward from the spine in a planar fashion in a direction opposite from the teeth; a slideable reference point slideably attached to the spine via grooves that extend the length of the spine along both sides of the spine, the slideable reference point having an elevated portion extending outward from the spine in a planar fashion, in a direction opposite from the teeth; wherein the slideable reference point clamps into the grooves; and wherein said elevated portions extend equidistant from said spine;

cutting a first area of the hairline to a desired shape;

placing the elevated portion of the fixed reference point of the comb at a first desired location in reference to the shape of the first area of the hairline;

adjusting the elevated portion of the slideable reference point to a desired location relative to the elevated portion of the fixed reference point to obtain a measurement of the first area;

while maintaining the measurement of the first area on the comb, placing the elevated portion of the fixed reference point of the comb at a second desired location in reference to a shape of a second area of the hairline;

identifying location of the elevated portion of the slideable reference point relative to the second area of the hairline; and cutting the second area of the hairline to accurately and reproducibly match the shape of the first area of the hairline.

* * * * *